US009140147B2

(12) United States Patent
Woo et al.

(10) Patent No.: US 9,140,147 B2
(45) Date of Patent: Sep. 22, 2015

(54) MULTIPLE VARIABLE VALVE LIFT APPARATUS

(71) Applicant: Hyundai Motor Company, Seoul (KR)

(72) Inventors: Soo Hyung Woo, Yongin-Si (KR); Jei Choon Yang, Yongin-si (KR); Young Hong Kwak, Suwon-si (KR); Byong Young Choi, Bucheon-si (KR); Jin Kook Kong, Suwon-si (KR); Gee Wook Shin, Ansan-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/145,446

(22) Filed: Dec. 31, 2013

(65) Prior Publication Data

US 2014/0251250 A1 Sep. 11, 2014

(30) Foreign Application Priority Data

Mar. 8, 2013 (KR) ..... 10-2013-0025208

(51) Int. Cl.
*F01L 1/34* (2006.01)
*F01L 1/047* (2006.01)
*F01L 13/00* (2006.01)

(52) U.S. Cl.
CPC ..... *F01L 1/047* (2013.01); *F01L 13/0036* (2013.01); *F01L 2001/0473* (2013.01); *F01L 2001/0475* (2013.01); *F01L 2013/0052* (2013.01); *F01L 2820/031* (2013.01)

(58) Field of Classification Search
CPC ..... F01L 1/047; F01L 13/0036; F01L 2001/0473; F01L 2001/0475; F01L 2013/0052; F01L 2820/031
USPC ..... 123/90.15–90.18, 90.48–90.5
See application file for complete search history.

(56) References Cited

U.S. PATENT DOCUMENTS

| | | | | |
|---|---|---|---|---|
| 5,988,127 | A * | 11/1999 | Hasegawa et al. | 123/90.18 |
| 7,146,952 | B2 * | 12/2006 | Kreil et al. | 123/90.5 |
| 8,893,678 | B2 * | 11/2014 | Schadel et al. | 123/90.18 |
| 2010/0126445 | A1 * | 5/2010 | Schiepp et al. | 123/90.16 |
| 2010/0242884 | A1 * | 9/2010 | Meintschel et al. | 123/90.21 |
| 2013/0104824 | A1 * | 5/2013 | Weinmeister | 123/90.18 |
| 2013/0306014 | A1 * | 11/2013 | Stolk et al. | 123/90.18 |

FOREIGN PATENT DOCUMENTS

WO WO 2012110069 A1 * 8/2012

* cited by examiner

*Primary Examiner* — Ching Chang
(74) *Attorney, Agent, or Firm* — Morgan, Lewis & Bockius LLP

(57) ABSTRACT

A multiple variable valve lift apparatus has a simple design that efficiently operates without interference. The apparatus according may include: a camshaft formed in a hollow cylinder shape; a control shaft disposed in the hollow of the camshaft; a cam that rotates together with the camshaft; a cam rod connecting the control shaft with the cam to move together; an operating unit disposed on the exterior circumference of the camshaft to rotate together with the camshaft; an operating unit rod connecting the control shaft with the operating unit such that the control shaft and the operating unit move together; a solenoid selectively connected with the operating unit, and moving the operating unit along an axial direction of the camshaft; and a tappet contacting the cam to transform rotational motion of the cam to rectilinear motion of a valve.

22 Claims, 13 Drawing Sheets

MULTIPLE VARIABLE VALVE LIFT APPARATUS

CROSS-REFERENCE TO RELATED APPLICATION

The present application claims priority of Korean Patent Application Number 10-2013-0025208 filed Mar. 8, 2013, the entire contents of which application is incorporated herein for all purposes by this reference.

BACKGROUND OF INVENTION

1. Field of Invention

The present invention relates to a variable valve lift apparatus. More particularly, the present invention relates to a multiple variable valve lift apparatus which is adapted to realize a plurality of valve lift modes.

2. Description of Related Art

Generally, an internal combustion engine generates power by combusting fuel and air supplied to a combustion chamber. Herein, an intake valve is operated by drive of a camshaft, and air flows into the combustion chamber during when the intake valve is open. In addition, an exhaust valve is operated by drive of a camshaft, and air is exhausted from the combustion chamber while the exhaust valve is open.

Meanwhile, optimal operations of the intake valve or the exhaust valve are determined according to rotation speed of the engine. That is, lift and open/close timing of the valves are properly controlled according to rotation speed of the engine. A variable valve lift (VVL) apparatus has been developed in which a plurality of cams for operating the valves are provided to the camshaft or the valves are operated for various lifts according to rotation speed of the engine for realizing optimal operations of the valves according to rotation speed of the engine.

When the plurality of cams are provided to the camshaft, however, the composition for selectively changing the cam to operate the intake valve or the exhaust valve may become complex, and interference between the elements of the composition may occur.

The information disclosed in this Background section is only for enhancement of understanding of the general background of the invention and should not be taken as an acknowledgement or any form of suggestion that this information forms the prior art already known to a person skilled in the art.

BRIEF SUMMARY

Various aspects of the present invention provide for a multiple variable valve lift apparatus having advantages of having a simple composition, and efficiently operating the elements of the composition without interference between them.

Various aspects of the present invention provide for a multiple variable valve lift apparatus that may include: a camshaft formed in a hollow cylinder shape, and rotating by drive of an engine; a control shaft disposed in the hollow of the camshaft; a cam disposed on an exterior circumference of the camshaft so as to rotate together with the camshaft; a cam rod connecting the control shaft with the cam such that the control shaft and the cam move together; an operating unit disposed on the exterior circumference of the camshaft so as to rotate together with the camshaft; an operating unit rod connecting the control shaft with the operating unit such that the control shaft and the operating unit move together; a solenoid selectively connected with the operating unit, and moving the operating unit along an axial direction of the camshaft; and a tappet contacting the cam so as to transform rotational motion of the cam to rectilinear motion of a valve.

The cam may include at least two cams in which shapes of the cam lobes are different from each other and move together with the operating unit along the axial direction of the camshaft such that a cam contacting the tappet of the at least two cams may be selected.

The cam may be formed in a cylinder shape having a hollow such that the camshaft is inserted therein.

A cam guide hole may be formed at the camshaft by penetrating the camshaft along a diameter direction, and the cam rod may penetrate the camshaft along a diameter direction through the cam guide hole so as to connect the cam with the control shaft.

The cam guide hole may be formed with a set length along the axial direction of the camshaft, and the cam rod may be guided by the cam guide hole so as to move together with the cam and the control shaft along the axial direction of the camshaft.

The operating unit may be formed in a cylinder shape having a hollow such that the camshaft is inserted therein.

An operating unit guide hole may be formed at the camshaft by penetrating the camshaft along a diameter direction, and the operating unit rod may penetrate the camshaft along the diameter direction through the operating unit guide hole so as to connect the operating unit with the control shaft.

The operating unit guide hole may be formed with a set length along the axial direction of the camshaft, and the operating unit rod may be guided by the operating unit guide hole so as to move together with the operating unit and the control shaft along the axial direction of the camshaft.

The control shaft may be connected with the plurality of cams so as to concurrently control valve lifts by applying it to at least two cylinder of an engine, that is, the control shaft may integrally, simultaneously, and/or concurrently control the plurality of cams and control lifts of a plurality of cylinders.

The control shafts may be provided such that the number thereof corresponds to the number of cylinders formed at an engine, and may be respectively connected to at least one cam so as to independently control valve lift by applying it to each cylinder of the engine.

The tappet may include a lower portion formed in a cylinder shape, and an upper portion protruded from an upper surface of the lower portion and roll-contacting the cam.

The upper portion may be formed in a hexahedral shape having a lower surface meeting the upper surface of the lower portion, an upper surface contacting the cam, and four side surfaces, and the upper surface of the upper portion may be elongated extending along one direction for extending the time that the tappet is operated by the cam lobe of the cam.

The upper surface of the upper portion may be convexly formed with a fluent curved surface along a length direction.

The tappet may further include a locking pin preventing relative rotation of the tappet with respect to a cylinder head, the locking pin may be formed in a bent shape so as to be mounted on the lower portion from a side surface to the upper surface of the lower portion, and a thickness of one direction of the upper portion may be smaller than a diameter of the lower portion as a set value for mounting the bent locking pin.

An operating portion selectively contacting the operating unit may be provided to the solenoid, a guide rail may be formed on an exterior circumference of the operating unit and be slanted with reference to an axial direction so as to guide the contacted operating portion, and the operating portion may be slid along the guide rail by rotation of the operating unit such that the operating unit moves along the axial direction of the camshaft.

There may be at least two guide rails formed for moving the operating unit in one direction or an opposite direction along the axial direction.

Each guide rail may be formed with a groove shape recessed from an exterior circumference of the operating unit, and the operating portion may be adapted to be inserted into the guide rail formed with the groove shape.

In a case that there are two guide rails formed with the groove shape, the two guide rails may be disposed so as to face each other along a diameter direction of the operating unit, a protrusion portion relatively protruded compared with the guide rail may be formed between the two guide rails on an exterior circumference of the operating unit, and the operating portion may escape from the guide rail when the operating portion passing the guide rail contacts the protrusion portion by rotation of the operating unit.

In a case that there are two guide rails formed with the groove shape, the two guide rails may be disposed to cross with an X-shape, a protrusion portion relatively protruded compared with the guide rail may be formed on a part of an exterior circumference of the operating unit where the two guide rails are not formed, and the operating portion may escape from the guide rail when the operating portion passing the guide rail contacts the protrusion portion by rotation of the operating unit.

The guide rail may be formed with a protrusion shape protruded from an exterior circumference of the operating unit, and a groove may be formed at the operating portion such that the guide rail formed in the protrusion shape is adapted to be inserted into the groove.

In a case that there are two guide rails formed with the protrusion shape, the two guide rails may be disposed so as to face each other along a diameter direction of the operating unit, a protrusion portion protruded from an exterior circumference of the operating unit may be formed between the two guide rails on an exterior circumference of the operating unit, and the operating portion may be moved back to its original position when the operating portion passing the guide rail contacts the protrusion portion by rotation of the operating unit.

In a case that there are two guide rails formed in the protrusion shape, the two guide rails may be disposed to cross with an X-shape, a protrusion portion protruded from an exterior circumference of the operating unit may be formed on a part of an exterior circumference of the operating unit where the two guide rails are not formed, and the operating portion may be moved back to its original position when the operating portion passing the guide rail contacts the protrusion portion by rotation of the operating unit.

The two guide rails may include a crossed rail formed with a rhomboid shape at the crossing point of the X-shape for sliding the groove of the operating portion, and a crossed groove formed such that the two guide rails are cut at a set distance around the crossed rail.

In a case that there are two guide rails formed, the two guide rails may be disposed such that the operating portion sequentially passes one end and the other end of either of the two guide rails and one end and the other end of the other of the two guide rails according to rotation of the operating unit in a state that the operating portion contacts the operating unit.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
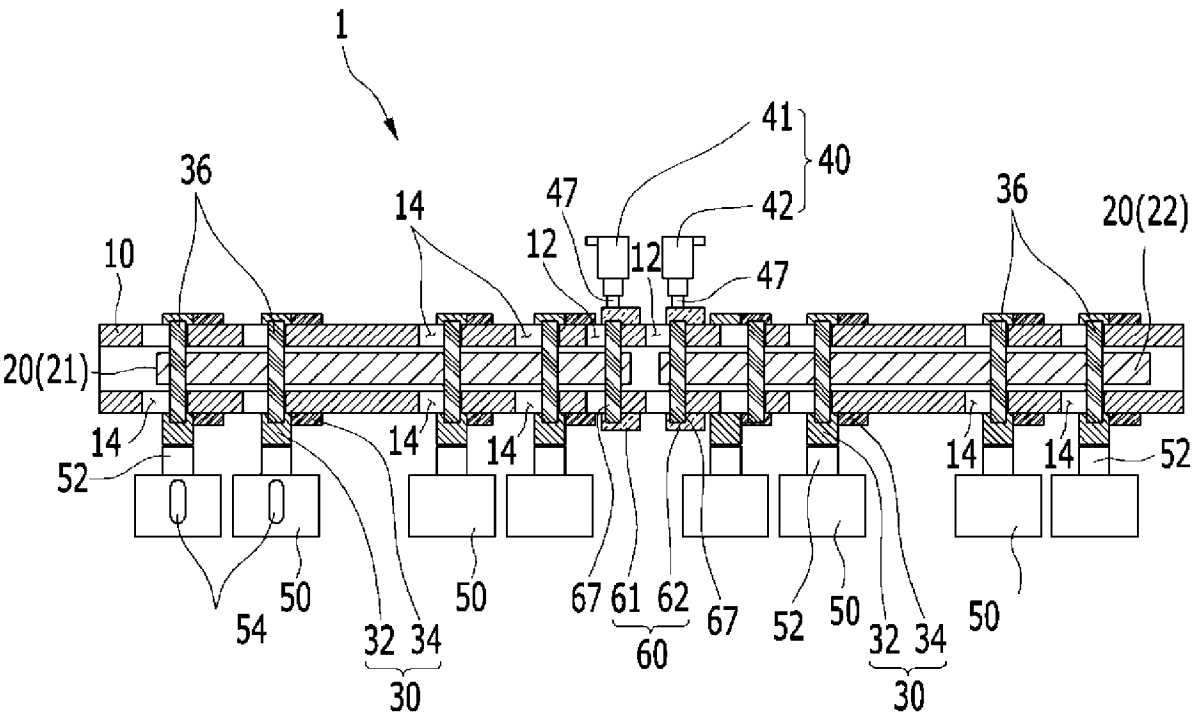
FIG. 1 is a drawing showing a state in which a tappet is in contact with a high lift cam of an exemplary multiple variable valve lift apparatus according to the present invention.
Figure 2:
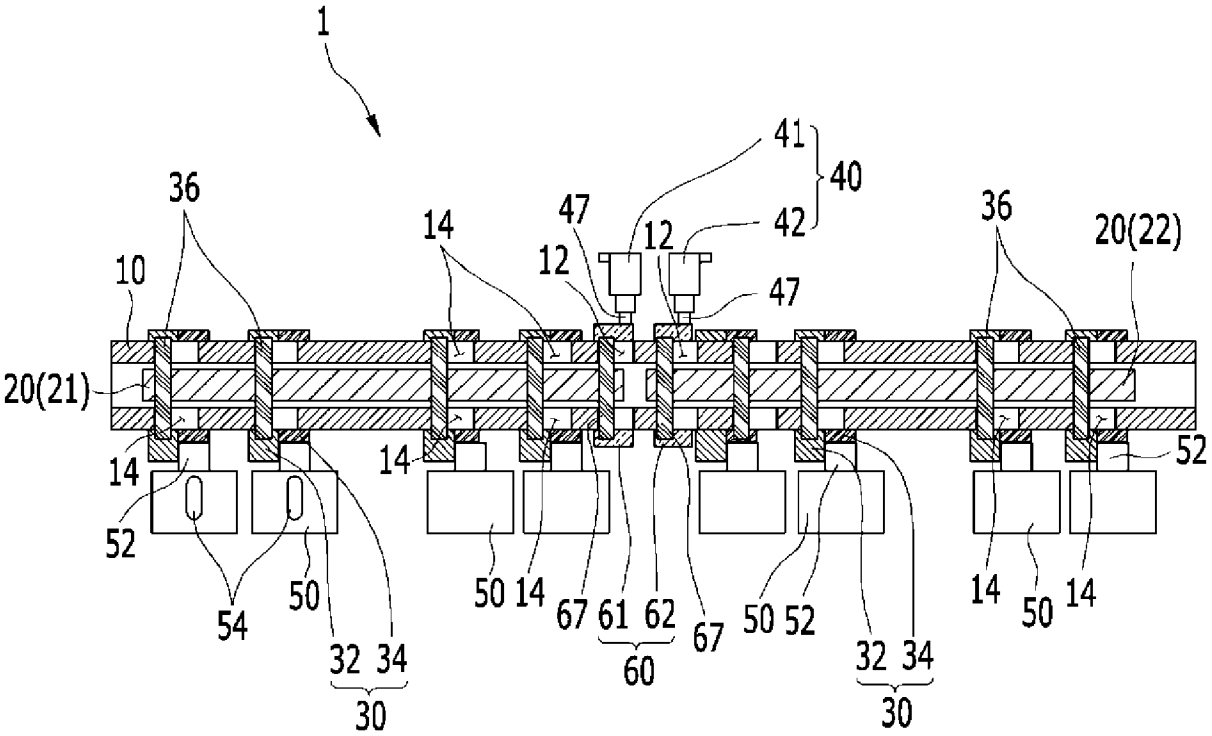
FIG. 2 is a drawing showing the state in which a tappet is in contact with a low lift cam of an exemplary multiple variable valve lift apparatus according to the present invention.

FIG. 1 is a drawing showing a state in which a tappet is in contact with a high lift cam of a multiple variable valve lift apparatus according to various embodiments of the present invention, and FIG. 2 is a drawing showing the state in which a tappet is in contact with a low lift cam of a multiple variable valve lift apparatus according to various embodiments of the present invention.

In FIG. 1 and FIG. 2, cross-sections of some constituent elements are represented in order to easily show constitutions of the multiple variable valve lift apparatus 1.

As shown in FIG. 1 and FIG. 2, a multiple variable valve lift apparatus 1 according to various embodiments of the present invention includes a camshaft 10, a cam 30, a control shaft 20, a solenoid 40, an operating unit 60, and a tappet 50.

The camshaft 10 is a shaft which rotates in conjunction with rotation of a crankshaft of an engine. In addition, the camshaft 10 is formed in a hollow cylinder shape.

The cam 30 is disposed to protrude from an exterior circumference of the camshaft 10. In detail, the cam 30 is formed in a hollow cylinder shape having a set thickness. The camshaft 10 is inserted into the hollow of the cam 30. Therefore, an overall shape of the cam 30 and the camshaft 10 is one in which the cam 30 is protruded from an exterior circumference of the camshaft 10. The hollow of the cam 30 may be formed in a circular shape corresponding with an external circumference of the camshaft 10. That is, an interior circumference of the cam 30 contacts an exterior circumference of the camshaft 10. Further, the cam 30 is adapted that an interior circumference thereof slides on an exterior circumference of the camshaft 10 so as to move along an axial direction of the camshaft 10. Meanwhile, the cam 30 is disposed so as to rotate together with the camshaft 10.

The cam 30 is formed such that one end thereof is protruded further compared with the other end thereof from an exterior circumference of the camshaft 10. For example, a cross-section of the cam 30 is formed such that an exterior circumference thereof has an oval shape. Herein, the one end of the cam 30 may be a cam lobe, and the other end of the cam 30 may be a cam base.

The cam base is a base circle of a cam, a part of an external circumference of the cam, which is formed in an arc shape having a uniform radius. In addition, the cam lobe is a part of an external circumference of the cam which pushes a valve 80 from when opening of the valve 80 is started to closing of the valve 80 is ended by rotation of the cam 30. Herein, the valve 80 is may be an intake valve or an exhaust valve of an engine (referring to FIG. 5).

The cam 30 includes a high lift cam 32 and a low lift cam 34.

The shapes of the high lift cam 32 and the low lift cam 34 are different from each other. Particularly, the cam lobe of the high lift cam 32 and the cam lobe of the low lift cam 34 are respectively formed in different shapes such that an opening time of the valve 80 according to the valve 80 being operated by the high lift cam 32 is different from an opening time of the valve 80 according to the valve 80 being operated by the low lift cam 34. In addition, the cam lobe of the high lift cam 32 protrudes further compared with the cam lobe of the low lift cam 34 from an exterior circumference of the camshaft 10. Therefore, the high lift cam 32 is adapted to realize a high lift of the valve 80, and the low lift cam 34 is adapted to realize a low lift of the valve 80. Further, either cam 30 operating the valve 80 of the high lift cam 32 and the low lift cam 34 is selected according to cam 30 movement along an axial direction of the camshaft 10.

The control shaft 20 is disposed in the hollow of the camshaft 10 so as to move along an axial direction of the camshaft 10. In addition, the control shaft 20 is connected with the cam 30. Further, the cam 30 is moved along an axial direction of the camshaft 10 according to the control shaft 20 moving along an axial direction of the camshaft 10. Herein, the control shaft 20 may move together with the cam 30.

The solenoid 40 is provided so as to transform rotational motion of the camshaft 10 to rectilinear motion of the control shaft 20. That is, the control shaft 20 is moved along an axial direction of the camshaft 10 by rotational motion of the camshaft 10 when the solenoid 40 is operated. Herein, the solenoid 40 operated to on or off by electric control is well-known to a person of ordinary skill in the art such that a detailed description thereof will be omitted.

The operating unit 60 is formed in a hollow cylinder shape like the cam 30, and the camshaft 10 is inserted into the hollow of the operating unit 60 so as to be disposed on an exterior circumference of the camshaft 10. In addition, the hollow of the operating unit 60 is formed such that an internal circumference of the operating unit 60 is formed in a shape corresponding with an external circumference of the camshaft 10. Further, an external circumference of the operating unit 60 is formed in a circle shape having a uniform radius.

The operating unit 60 is selectively connected with the solenoid 40 by on or off switching of the solenoid 40. In addition, a part of the solenoid 40 contacts an exterior circumference of the operating unit 60 when the operating unit 60 is connected with the solenoid 40. Further, a part of the solenoid 40 is slid along an exterior circumference of the operating unit 60 by rotation of the camshaft 10. An interior circumference of the operating unit 60 is slid on an exterior circumference of the camshaft 10 and the operating unit 60 is moved along an axial direction of the camshaft 10 by the operation of the solenoid 40 and the operating unit 60.

The operating unit 60 is connected with the control shaft 20. In addition, the control shaft 20 is moved along an axial direction of the camshaft 10 according to the operating unit 60 movement along an axial direction of the camshaft 10. That is, the operating unit 60, the control shaft 20, and the cam 30 may move together. Meanwhile, the operating unit 60 is disposed so as to rotate together with the camshaft 10.

The tappet 50 is provided to transform rotational motion of the cam 30 to rectilinear motion of the valve 80. In addition, the tappet 50 contacts an exterior circumference of the cam 30, and is pushed by the cam lobe or is moved back to its original position by the cam base according to rotation of the cam 30. Herein, an elastic member may be provided such that the tappet 50 is always pushed toward the cam 30. Meanwhile, the valve 80 is coupled with the tappet 50 so as to be moved together with the tappet 50 by rotation of the cam 30 (referring to FIG. 5).

As described above, the tappet 50 is operated by the high lift cam 32 (referring to FIG. 1) or the low lift cam 34 (referring to FIG. 2) according to the operating unit 60, and the control shaft 20 and the cam 30 rectilinearly move along an axial direction of the camshaft 10. In addition, the operating time of the solenoid 40 operating to selectively contact either one of the high lift cam 32 or the low lift cam 34 with the tappet 50 can be predetermined by considering a driving state of an engine by a person of ordinary skill in the art.

In FIG. 1 and FIG. 2, a multiple variable valve lift apparatus 1 adapted to be applied to a four-cylinder engine is represented. In addition, FIG. 1 and FIG. 2 show that two tappets 50 are respectively disposed for each cylinder, and the one cam 30 including the one high lift cam 32 and the one low lift cam 34 respectively contacts each tappet 50. Further, two solenoids 40, two operating units 60, and two control shafts 20 are represented in FIG. 1 and FIG. 2.

The two solenoids 40 include a first and second cylinder integration solenoid 41 which combinatively, that is, integrally, simultaneously, and/or concurrently controls the time to open or close the valves 80 of the first and second cylinders, and a third and fourth cylinder integration solenoid 42 which combinatively, that is, integrally, simultaneously, and/or concurrently controls the time to open or close the valves 80 of the third and fourth cylinders. Therefore, the time to open or close the valves 80 of the first and second cylinders and the time to open or close the valves 80 of the third and fourth cylinders are controlled independently.

The two operating units 60 includes a first and second cylinder integration operating unit 61 selectively connected to the first and second cylinder integration solenoid 41, and a third and fourth cylinder integration operating unit 62 selectively connected to the third and fourth cylinder integration solenoid 42.

The two control shafts 20 include a first and second cylinder integration shaft 21 adapted to move together with the first and second cylinder integration operating unit 61, and a third and fourth cylinder integration shaft 22 adapted to move together with the third and fourth cylinder integration operating unit 62. In addition, the first and second cylinder integration shaft 21 is connected with the cams 30 contacting the tappets 50 of the first and second cylinders so as to rectilinearly move together, and the third and fourth cylinder integration shaft 21 is connected with the cams 30 contacting the tappets 50 of the third and fourth cylinders so as to rectilinearly move together.

In the description of FIG. 1 and FIG. 2, even though a multiple variable valve lift apparatus 1 according to various embodiments of the present invention is described based on a four-cylinder engine for better comprehension and ease of description, the variable valve lift apparatus 1 is not limited thereto, and can be applied to various engines by a person of ordinary skill in the art for combinatively, that is, integrally, simultaneously, and/or concurrently controlling the time to open or close the valves 80 of at least two cylinders.

Figure 3:
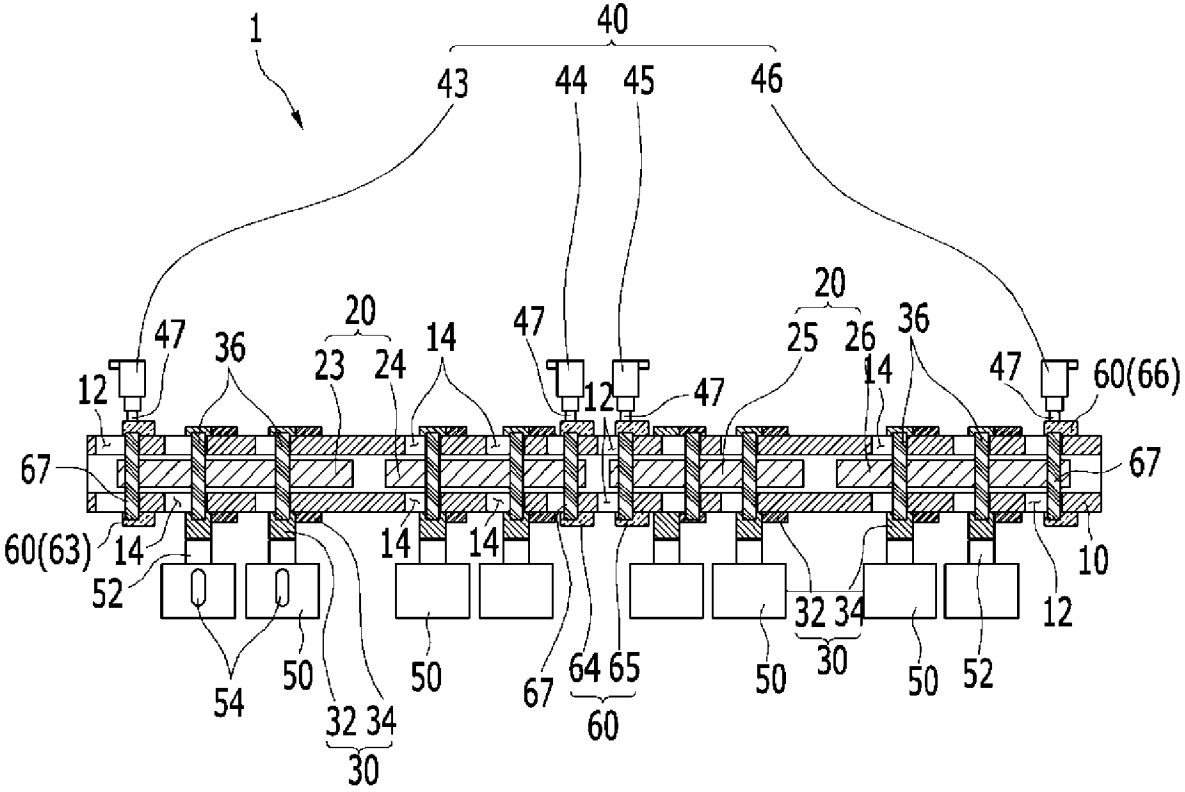
FIG. 3 is a schematic diagram of an exemplary multiple variable valve lift apparatus according to the present invention.

FIG. 3 is a schematic diagram of a multiple variable valve lift apparatus according to various embodiments of the present invention.

In FIG. 3, even though the state in which the high lift cam 32 of the multiple variable valve lift apparatus 1 contacts the tappet 50 is represented, the low lift cam 34 can contact the tappet 50 by the operation of the multiple variable valve lift apparatus 1. In addition, cross-sections of some constituent elements are represented in order to easily show constitutions of the multiple variable valve lift apparatus 1 in FIG. 3.

In the description regarding the multiple variable valve lift apparatus according to various embodiments of the present invention which is illustrated in FIG. 3, repeated descriptions regarding the constituent elements that are the same as in the multiple variable valve lift apparatus according to various embodiments of the present invention illustrated in FIG. 1 and FIG. 2 will be omitted.

As shown in FIG. 3, a multiple variable valve lift apparatus 1 according to various embodiments of the present invention independently controls the time to open or close the valves 80 disposed at each cylinder of an engine.

In FIG. 3, a multiple variable valve lift apparatus 1 adapted to be applied to a four-cylinder engine is represented. In addition, FIG. 3 shows that the two tappets 50 are respectively disposed for each cylinder, and the one cam 30 including the one high lift cam 32 and the one low lift cam 34 respectively contacts each tappet 50. Further, four solenoids 40, four operating units 60, and four control shafts 20 are represented in FIG. 3.

The four solenoids 40 include a first cylinder solenoid 43 which controls the time to open or close the valve 80 of the first cylinder, a second cylinder solenoid 44 which controls the time to open or close the valve 80 of the second cylinder, a third cylinder solenoid 45 which controls the time to open or close the valve 80 of the third cylinder, and a fourth cylinder solenoid 46 which controls the time to open or close the valve 80 of the fourth cylinder.

The four operating units 60 include a first cylinder operating unit 63 selectively connected with the first cylinder solenoid 43, a second cylinder operating unit 64 selectively connected with the second cylinder solenoid 44, a third cylinder operating unit 65 selectively connected with the third cylinder solenoid 45, and a fourth cylinder operating unit 66 selectively connected with the fourth cylinder solenoid 46.

The four control shafts 20 include a first cylinder shaft 23 adapted to move together with the first cylinder operating unit 63, a second cylinder shaft 24 adapted to move together with the second cylinder operating unit 64, a third cylinder shaft 25 adapted to move together with the third cylinder operating unit 65, and a fourth cylinder shaft 26 adapted to move together with the fourth cylinder operating unit 66. In addition, the first cylinder shaft 23, the second cylinder shaft 24, the third cylinder shaft 25, and the fourth cylinder shaft 26 are respectively connected with each cam 30 respectively contacting the tappets 50 of the first cylinder, the second cylinder, the third cylinder, and the fourth cylinder so as to rectilinearly move together.

In the description of FIG. 3, even though a multiple variable valve lift apparatus 1 according to various embodiments of the present invention is described based on a four-cylinder engine for better comprehension and ease of description, the variable valve lift apparatus 1 is not limited thereto, and can be applied to various engines by a person of ordinary skill in the art for independently controlling the time to open or close the valve 80 of each cylinder.

Meanwhile, even though the phases of the cams 30 disposed at the first to fourth cylinders are represented to be the same phase in FIG. 1 to FIG. 3 in order to easily show constitutions of a multiple variable valve lift apparatus 1, the phases of the cams 30 can be differently predetermined for each cylinder by a person of ordinary skill in the art. That is, opening and closing of each intake valve or exhaust valve can be differently predetermined. A normal ignition order of a four-cylinder engine is sequentially performed to the first cylinder, the third cylinder, the fourth cylinder, and the second cylinder, and thus it is well-known to a person of ordinary skill in the art that the time to open or close an intake valve or an exhaust valve for each cylinder is determined according to the ignition order such that a detailed description thereof will be omitted.

Figure 4:
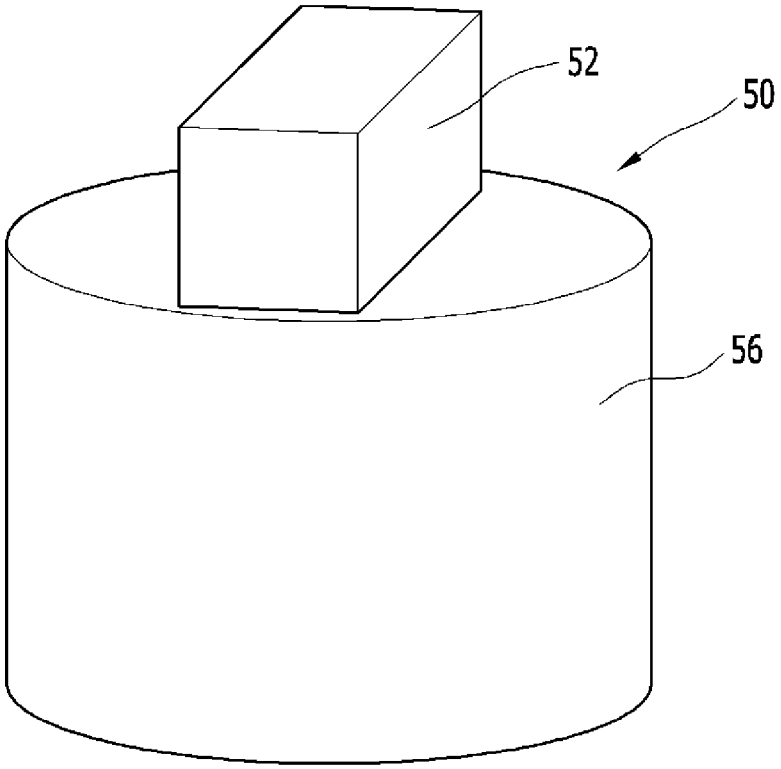
FIG. 4 is a perspective view of an exemplary tappet according to the present invention.

FIG. 4 is a perspective view of a tappet according to various embodiments of the present invention.

As shown in FIG. 4, a tappet 50 according to various embodiments of the present invention includes a lower portion 56 and an upper portion 52.

The lower portion 56 is a body of the tappet 50. In addition, the lower portion 56 is formed in a cylindrical shape.

The upper portion 52 is a portion which roll-contacts the cam 30. In addition, the upper portion 52 is formed to protrude from an upper surface of the lower portion 56. Further, the upper portion 52 may be formed in a hexahedral shape having six surfaces to include a lower surface meeting the upper surface of the lower portion 56. That is, the upper portion 52 includes two pairs of side surfaces. Herein, a thickness between one pair of side surfaces of two pairs of side surfaces of the upper portion 52 is set to a maximum approximate value with a diameter of the lower portion 56. Therefore, an upper surface of the upper portion 52 contacting the cam 30 is elongated extending along one direction, and the operating time of the tappet 50 by the cam lobe is extended as much as possible. Meanwhile, the upper surface of the upper portion 52 may be convexly formed in a fluent curved surface along the length direction such the operating time of the tappet 50 by the cam lobe is further extended.

Figure 5:
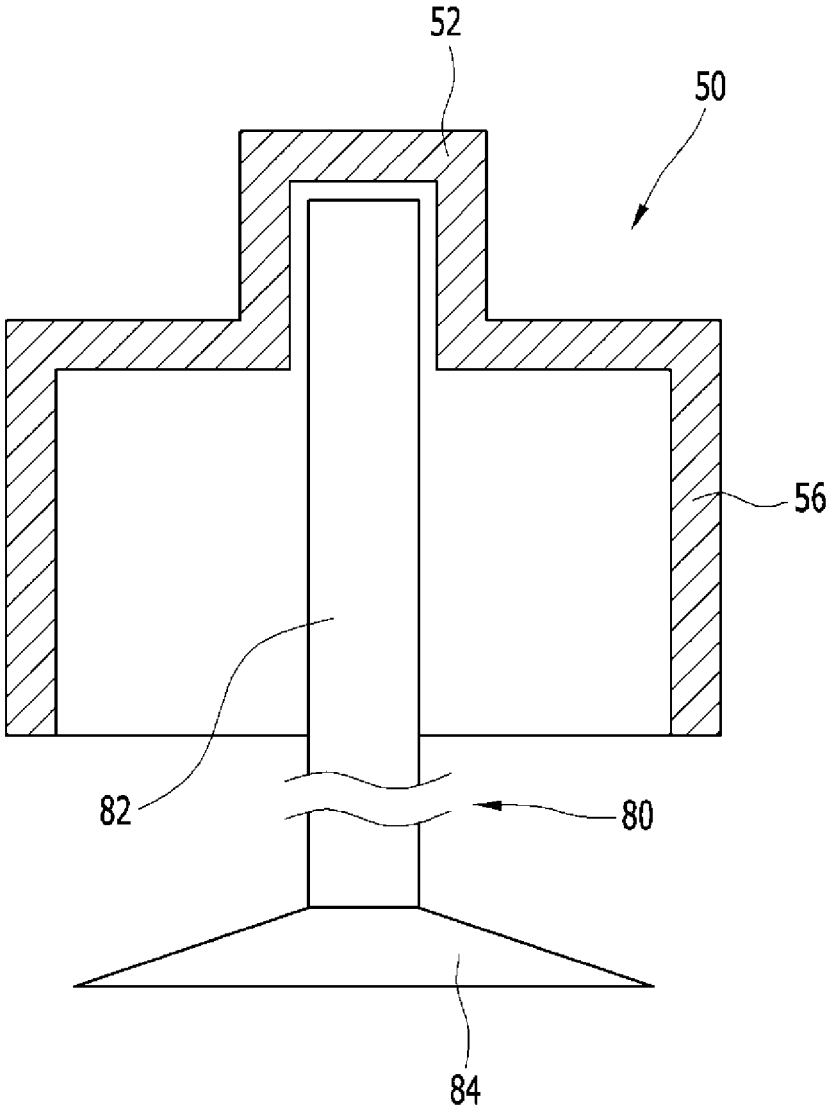
FIG. 5 is a cross-sectional view of an exemplary tappet according to the present invention.

FIG. 5 is a cross-sectional view of a tappet according to various embodiments of the present invention.

As shown in FIG. 5, the tappet 50 couples with the valve 80.

A lower surface of the lower portion 56 is opened, and an empty space is formed inside of the lower portion 56. In addition, the lower surface of the upper portion 52 meeting the upper surface of the lower portion 56 is opened, and an empty space communicating with the empty space of the lower portion 56 is formed inside of the upper portion 52. Meanwhile, the upper portion 52 and the lower portion 56 of the tappet 50 may be integrally formed. One will appreciate that such integral components may be monolithically formed.

The valve 80 includes a valve rod 82 and an opening/closing portion 84.

The valve rod 82 is formed in a long rod shape. In addition, one end of the valve rod 82 is inserted into the tappet 50 so as to pass through the lower surface of the lower portion 56 and the lower surface of the upper portion 52.

The opening/closing portion 84 is provided for selectively opening or closing an intake port or an exhaust port of an engine. In addition, when the tappet 50 pushes one end of the valve rod 82 according to an operation of the tappet 50 by rotation of the cam 30, the opening/closing portion 84 is moved so as to open the intake port or the exhaust port. Further, an elastic member is provided for returning the opening/closing portion 84.

Figure 6:
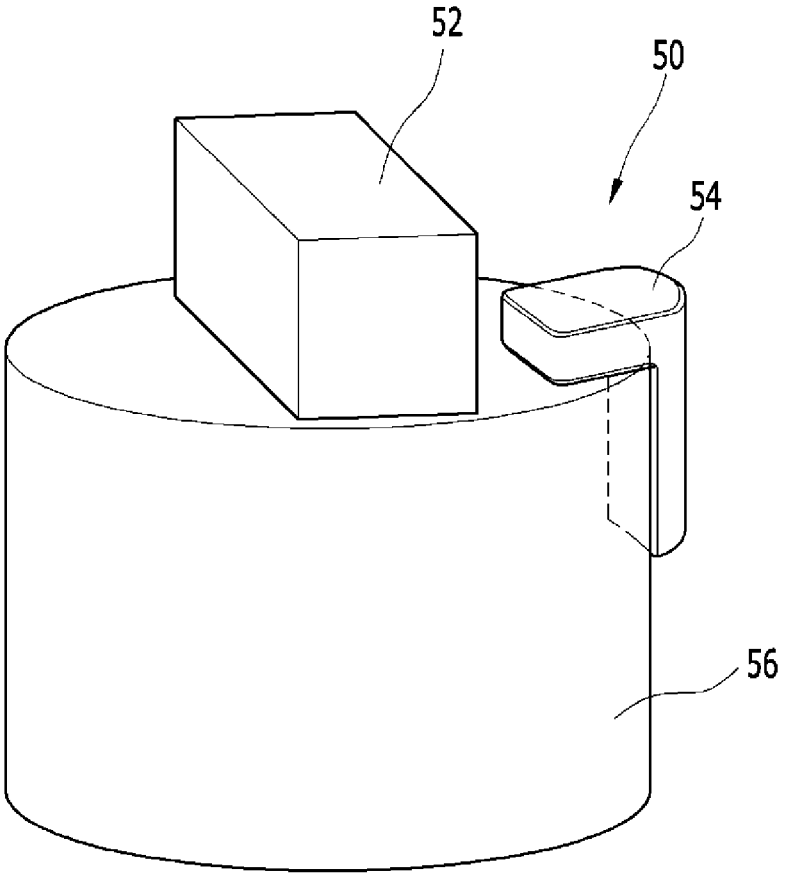
FIG. 6 is a perspective view of an exemplary tappet having a locking pin according to the present invention.

FIG. 6 is a perspective view of a tappet having a locking pin according to various embodiments of the present invention.

As shown in FIG. 6, the tappet 50 according to various embodiments of the present invention further includes the locking pin 54.

The locking pin 54 prevents the tappet 50 from relatively rotating with respect to a cylinder head. The locking pin 54 is mounted on the tappet 50, and a groove is formed in a shape corresponding to the locking pin 54 at the cylinder head. In addition, the locking pin 54 is slid to be seated in the groove of the cylinder head when the tappet 50 moves. Therefore, the tappet 50 is prevented from spinning with no traction from the cylinder head.

The locking pin 54 is formed in a bent shape so as to be mounted on the lower portion 56 from a side surface to the upper surface of the lower portion 56. A thickness between the other pair of side surfaces of the two pairs of side surfaces of the upper portion 52 is shorter than the diameter of the lower portion 56 such that the locking pin 54 formed with the bent shape is mounted on the lower portion 56. Therefore, a space for mounting the locking pin 54 is ensured on the upper surface of the lower portion 56. In addition, the locking pin 54 is strongly fixed on the tappet 50 as the locking pin 54 is mounted on the lower portion 56 from the side surface to the upper surface of the lower portion 56.

Figure 7:
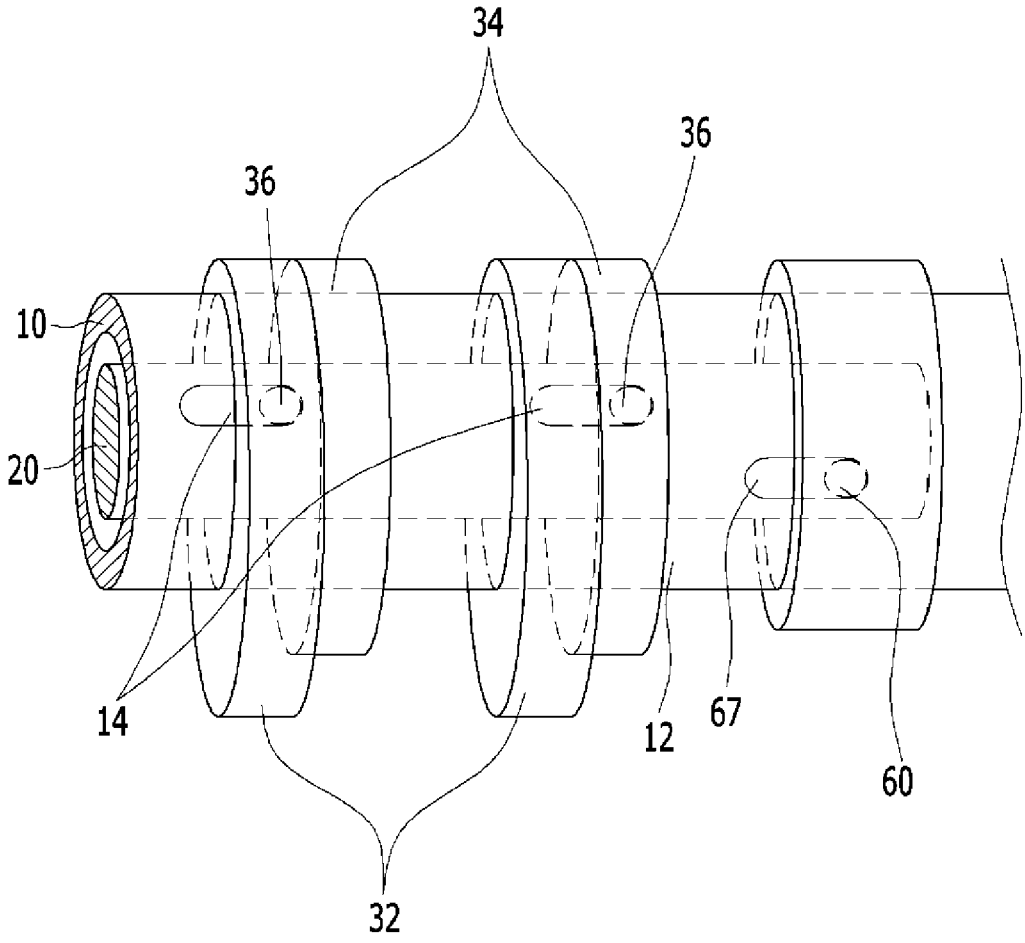
FIG. 7 is a partially enlarged view of an exemplary multiple variable valve lift apparatus according to the present invention.

FIG. 7 is a partially enlarged view of a multiple variable valve lift apparatus according to various embodiments of the present invention.

As shown in FIG. 7, the cam 30 further includes a cam rod 36, the operating unit 60 includes an operating unit rod 67, and the camshaft 10 includes an operating unit guide hole 12 and a cam guide hole 14.

Hereinafter, the cam rod 36, the operating unit rod 67, the operating unit guide hole 12, and the cam guide hole 14 will be described with reference to FIG. 1 to FIG. 3 and FIG. 7.

The cam rod 36 is disposed to cross the hollow of the cam 30 and the hollow of the camshaft 10 so as to penetrate the camshaft 10 and the control shaft 20 along a diameter direction. In addition, the cam rod 36 is fixed to the high lift cam 32 or the low lift cam 34. That is, the cam rod 36 moves together with the cam 30. Further, the cam rod 36 penetrates the control shaft 20 for connecting the cam 30 and the control shaft 20 such that the cam 30 and the control shaft 20 are moved together.

The operating unit rod 67 is disposed to cross the hollow of the operating unit 60 and the hollow of the camshaft 10 so as to penetrate the camshaft 10 and the control shaft 20 along a diameter direction. In addition, the operating unit rod 67 is fixed to the operating unit 60. That is, the operating unit rod 67 moves together with the operating unit 60. Further, the operating unit rod 67 penetrates the control shaft 20 for connecting the operating unit 60 and the control shaft 20 such that the operating unit 60 and the control shaft 20 are moved together.

The operating unit guide hole 12 and the cam guide hole 14 are holes which are formed to penetrate from an exterior circumference of the camshaft 10 to the hollow of the camshaft 10.

The operating unit guide hole 12 is formed to guide the operating unit 60. In addition, the operating unit guide hole 12 is formed with a set length along an axial direction of the camshaft 10, and is formed with a length corresponding to a thickness of the operating unit rod 67 along a circumferential direction of the camshaft 10. Further, the operating unit guide hole 12 includes a pair of holes which face each other in a diameter direction the camshaft 10. One end of the operating unit rod 67 penetrating the camshaft 10 and control shaft 20 is disposed in either one of the pair of operating unit guide holes 12, and the other end of the operating unit rod 67 is disposed in the other of the pair of operating unit guide holes 12. That is, the one end and the other end of the operating unit rod 67 are respectively slid along either one of the pair of operating unit guide holes 12 such that the operating unit 60 moves along an axial direction of the camshaft 10 without relative rotation with the camshaft 10.

The cam guide hole 14 is formed to guide the cam 30. In addition, the cam guide hole 14 is formed with a set length along an axial direction of the camshaft 10, and is formed with a length corresponding to a thickness of the cam rod 36 along a circumferential direction of the camshaft 10. Further, the cam guide hole 14 includes a pair of holes which face each other in a diameter direction the camshaft 10. Herein, one end of the cam rod 36 penetrating the camshaft 10 and control shaft 20 is disposed in either one of the pair of cam guide holes 14, and the other end of the cam rod 36 is disposed in the other of the pair of cam guide holes 14. That is, the one end and the other end of the cam rod 36 are respectively slid along either one of the pair of cam guide holes 14 such that the cam 30 moves along an axial direction of the camshaft 10 without relative rotation with the camshaft 10.

Herein, the axial direction length of the operating unit guide hole 12 and cam guide hole 14 is long so as to move the operating unit rod 67 and the cam rod 36 such that the cam 30 contacting the tappet 50 is changed from the high lift cam 32 to the low lift cam 34 or the opposite thereof. Meanwhile, the size of the operating unit guide hole 12 and cam guide hole 14 are differently formed from each other according to each thickness of the operating unit rod 67 and the cam rod 36.

Figure 8:
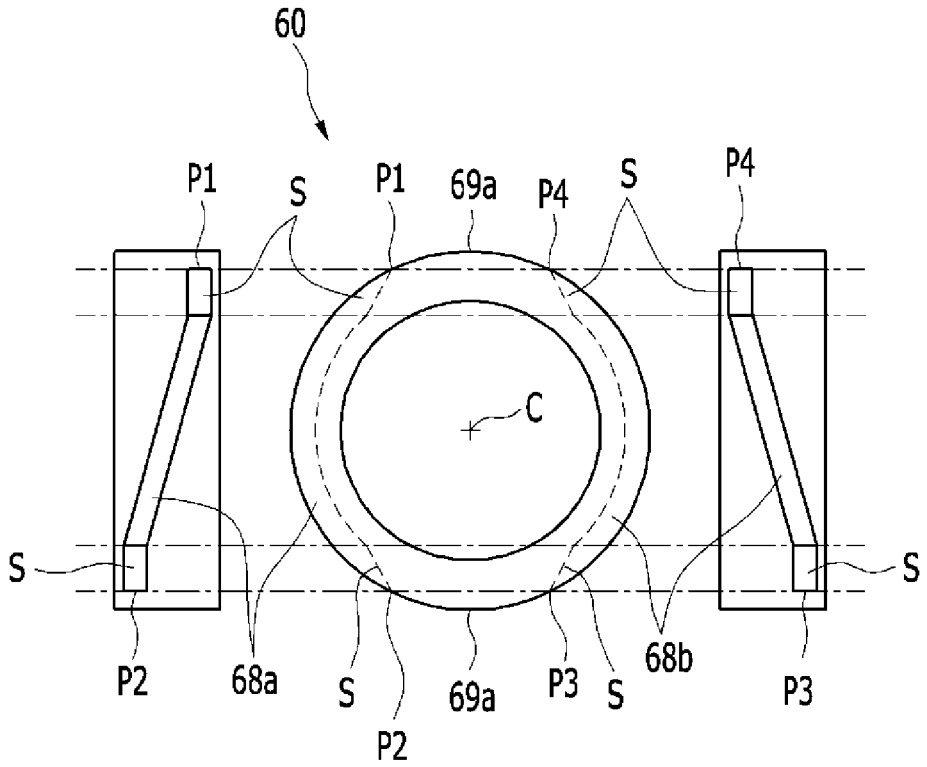
FIG. 8 is a drawing showing an exemplary operating unit having a guide rail formed in a groove shape.
Figure 9:
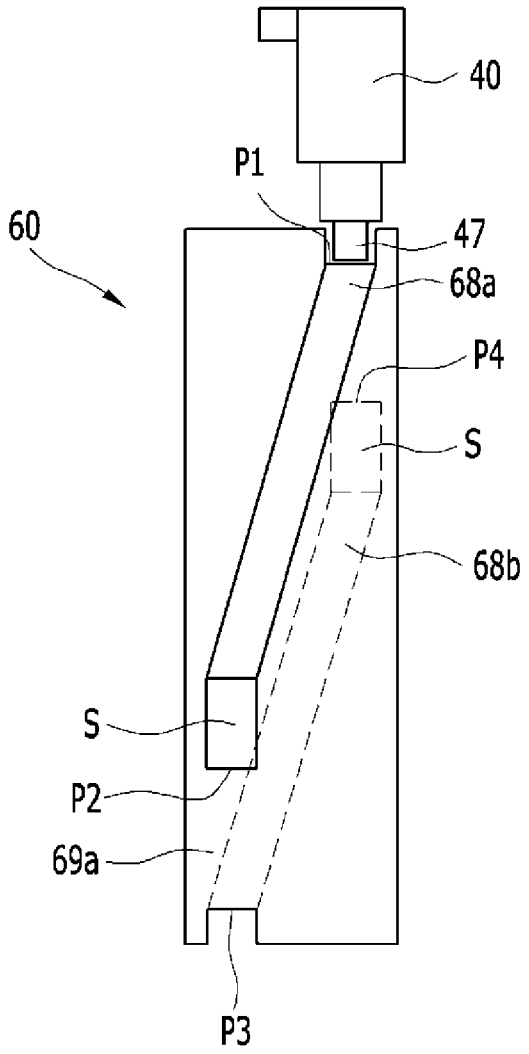
FIG. 9 is a drawing showing an exemplary operating unit having a guide rail formed in a groove shape and a solenoid.
Figure 10:
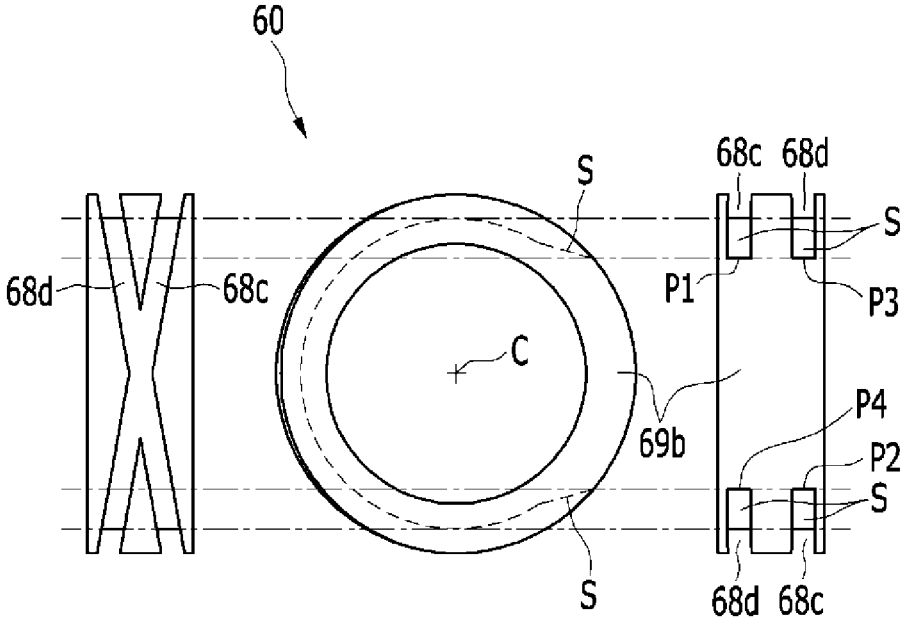
FIG. 10 is a drawing showing an exemplary operating unit having a guide rail formed in a groove shape.

FIG. 8 is a drawing showing an operating unit having a guide rail formed in a groove shape, and FIG. 9 is a drawing showing an operating unit having a guide rail formed in a groove shape and a solenoid. In addition, FIG. 10 is a drawing showing an operating unit having a guide rail formed in a groove shape.

Figure 11:
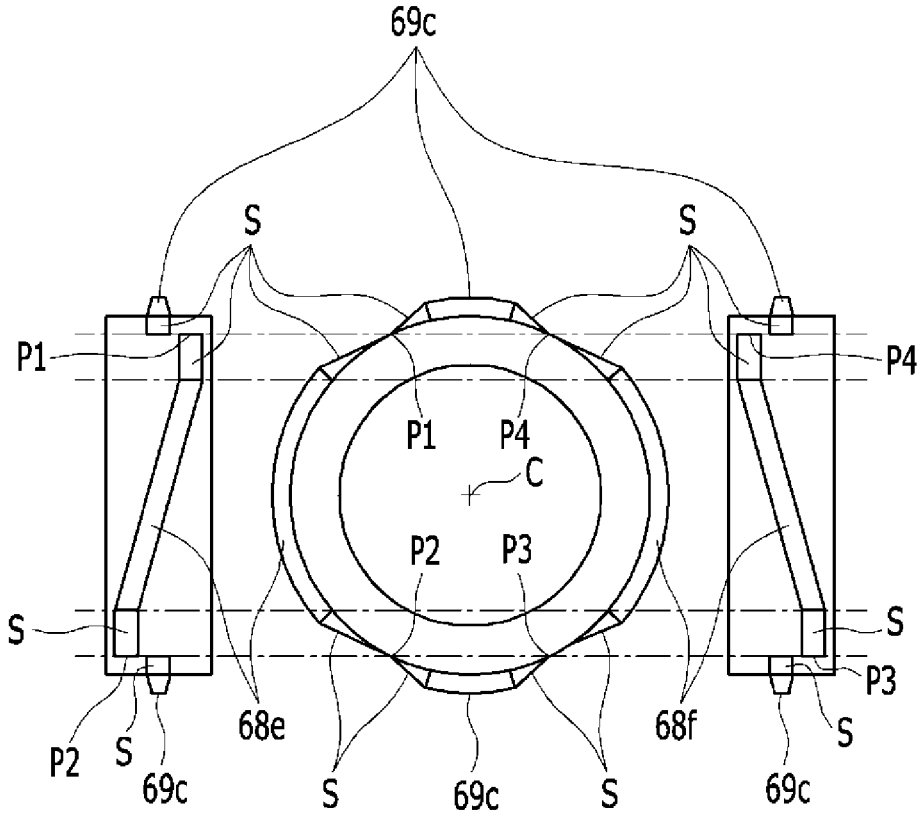
FIG. 11 is a drawing showing an exemplary operating unit having a guide rail formed in a protrusion shape.
Figure 12:
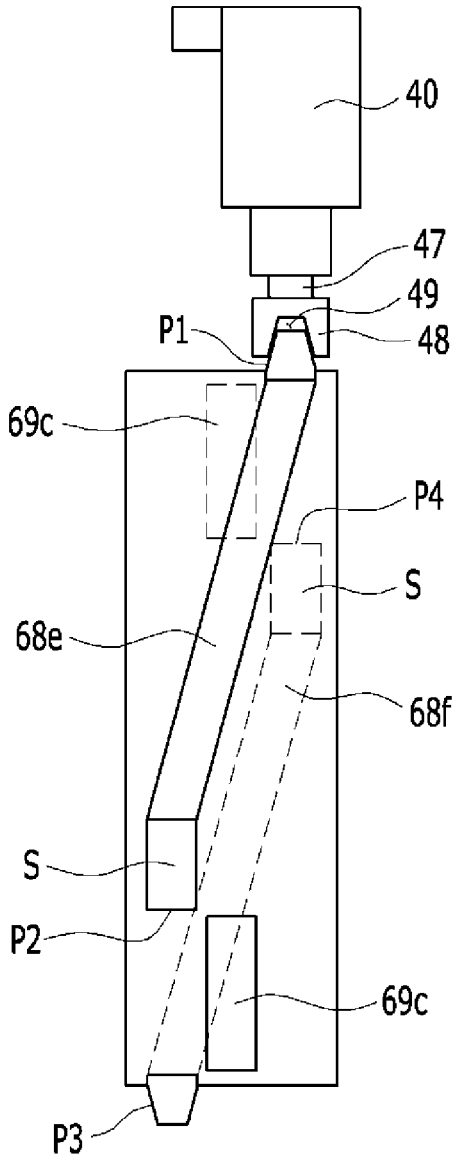
FIG. 12 is a drawing showing an exemplary operating unit having a guide rail formed in a protrusion shape and a solenoid.
Figure 13:
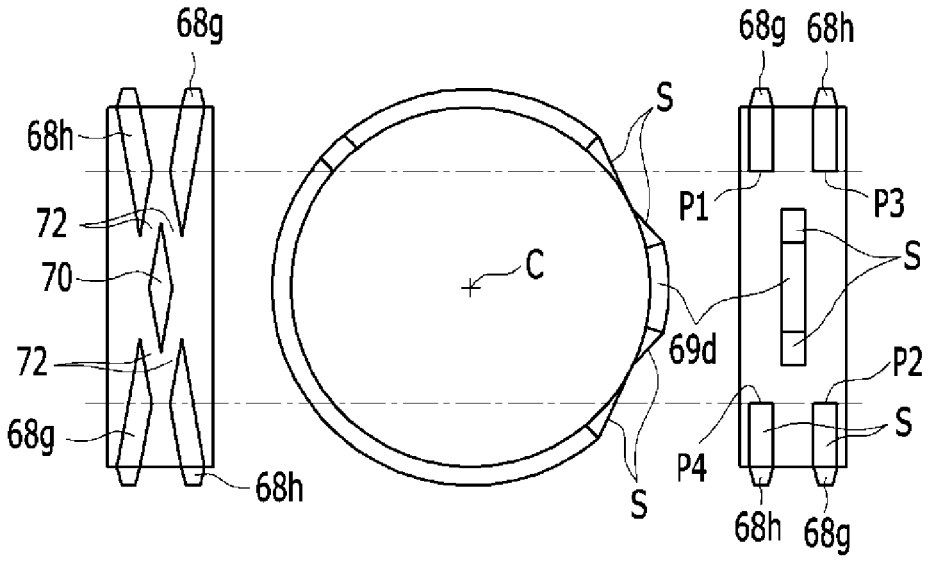
FIG. 13 is a drawing showing an exemplary operating unit having a guide rail formed in a protrusion shape.

FIG. 11 is a drawing showing an operating unit having a guide rail formed in a protrusion shape, and FIG. 12 is a drawing showing an operating unit having a guide rail formed in a protrusion shape and a solenoid. In addition, FIG. 13 is a drawing showing an operating unit having a guide rail formed in a protrusion shape.

As shown in FIG. 8 to FIG. 13, the operating unit 60 further includes a guide rail (68*a*, 68*b*, 68*c*, 68*d*, 68*e*, 68*f*, 68*g*, 68*h*), and as shown in FIG. 9 and FIG. 11, the solenoid 40 includes an operating portion 47.

The operating unit 60 and the solenoid 40 are connected by contacting the guide rail (68*a*, 68*b*, 68*c*, 68*d*, 68*e*, 68*f*, 68*g*, 68*h*) with the operating portion 47. In addition, the operating portion 47 selectively contacts the guide rail (68*a*, 68*b*, 68*c*, 68*d*, 68*e*, 68*f*, 68*g*, 68*h*) according to operation of the solenoid 40. Further, the guide rail (68*a*, 68*b*, 68*c*, 68*d*, 68*e*, 68*f*, 68*g*, 68*h*) is formed to guide the operating portion 47 at an exterior circumference of the operating unit 60.

Various embodiments in which the guide rails 68*a* and 68*b* having a groove shape is formed at the operating unit 60 will now be described with reference to FIG. 8 and FIG. 9.

The guide rails 68*a* and 68*b* may be formed in a groove shape recessed from an exterior circumference of the operating unit 60. In addition, the groove shape guide rails 68*a* and 68*b* are elongated extending along a circumferential direction of the operating unit 60, and are slanted by a set slope with reference to an axial direction.

The operating portion 47 is slid along a length direction of the guide rails 68*a* and 68*b* by rotation of the camshaft 10 and the operating unit 60 if the operating portion 47 of the solenoid 40 contacts the guide rails 68*a* and 68*b*. Herein, the solenoid 40 is fixed to a vehicle body, and thus the operating portion 47 is fixed, and the operating unit 60 is moved along an axial direction of the camshaft 10 according to the shape of the slanted guide rails 68*a* and 68*b* by the fixed operating portion 47. Meanwhile, the camshaft 10 and the operating unit 60 are concentrically rotated about a same rotating center point C.

The groove shape guide rails 68*a* and 68*b* may be a pair of guide rails 68*a* and 68*b*, and the two guide rails 68*a* and 68*b* are disposed so as to face each other along a diameter direction of the operating unit 60. In addition, a protrusion portion 69*a* is formed between the two guide rails 68*a* and 68*b*. Herein, the protrusion portion 69*a* is a portion which is relatively protruded compared with the groove shape guide rails 68*a* and 68*b*, and is a part of an exterior circumference of the operating unit 60 which is not recessed.

One guide rail 68*a* of the two guide rails 68*a* and 68*b* is formed to slant so as to move the operating unit 60 in one direction along an axial direction of the camshaft 10, and the other guide rail 68*b* of the two guide rails 68*a* and 68*b* is formed to slant so as to move the operating unit 60 in an opposite direction along an axial direction of the camshaft 10. In addition, the one guide rail 68*a* includes a starting point P1 at one end thereof and an ending point P2 at the other end thereof, and the other guide rail 68*b* includes a starting point P3 at one end and an ending point P4 at the other end. That is, the protrusion portions 69*a* are respectively formed between the ending point P2 and the starting point P3, and between the ending point P4 and the starting point P1.

If the operating portion 47 of the solenoid 40 contacts the starting point P1, the operating portion 47 is slid to the ending point P2 along the one guide rail 68*a* by rotation of the operating unit 60. Thus, the operating unit 60 is moved in the one direction.

The operating portion 47 that has slid to the ending point P2 begins to escape from the one guide rail 68*a* at the same time that the operating portion 47 contacts the protrusion portion 69*a*. In addition, the operating portion 47 passes through the protrusion portion 69*a* by rotation of the operating unit 60.

If the operating portion 47 passing through the protrusion portion 69*a* between the ending point P2 and the starting point P3 contacts the starting point P3, the operating portion 47 is slid to the ending point P4 along the other guide rail 68*b* by rotation of the operating unit 60. Thus, the operating unit 60 is moved in the opposite direction.

The operating portion 47 that has slid to the ending point P4 begins to escaped from the other guide rail 68*b* at the same time that the operating portion 47 contacts the protrusion portion 69*a*. In addition, the operating portion 47 passes through the protrusion portion 69*a* by rotation of the operating unit 60. Further, the operating portion 47 passing through the protrusion portion 69*a* between the ending point P4 and the starting point P1 may contact the starting point P1.

As there are two groove shaped guide rails 68*a* and 68*b* disposed so as to face each other along a diameter direction of the operating unit 60, the operating unit 60 performs one reciprocal rectilinear motion per rotation of the operating unit 60. That is, high-low-high lift or the low-high-low lift of the valve 80 can be sequentially performed per rotation of the operating unit 60. This means that changing from the high lift to the low lift or from the low lift to the high lift can be performed every a half rotation of the camshaft 10, and the changing time of the lift may be predetermined by a person of ordinary skill in the art.

Meanwhile, a slanted surface S, having a shape such that the guide rails 68*a* and 68*b* are gradually recessed from an exterior circumference of the operating unit 60, is formed at portions of the starting points P1 and P3 and the ending points P2 and P4. Therefore, the operating portion 47 of the solenoid 40 can be smoothly seated on the guide rails 68*a* and 68*b* without impact, and can smoothly escape from the guide rail 68*a* and 68*b* *without impact*.

Various embodiments in which other guide rails 68*c* and 68*d* having a groove shape are formed at the operating unit 60 will now be described with reference to FIG. 10.

The guide rails 68*c* and 68*d* may be formed with a groove shape recessed from an exterior circumference of the operating unit 60. In addition, the groove shape guide rails 68*c* and 68*d* are elongated extending formed along a circumferential direction of the operating unit 60, and are slanted by a set slope with reference to an axial direction.

The operating portion 47 is slid along a length direction of the guide rails 68*c* and 68*d* by rotation of the camshaft 10 and the operating unit 60 if the operating portion 47 of the solenoid 40 contacts the guide rails 68*c* and 68*d*. Herein, the solenoid 40 is fixed to a vehicle body, and thus the operating portion 47 is fixed, and the operating unit 60 is moved along an axial direction of the camshaft 10 according to the shape of the slanted guide rails 68*c* and 68*d* by the fixed operating portion 47. Meanwhile, the camshaft 10 and the operating unit 60 are concentrically rotated about a same rotating center point C.

The groove shape guide rails 68*c* and 68*d* include one guide rail 68*c* formed to slant for moving the operating unit 60 in one direction along an axial direction of the camshaft 10, and the other guide rail 68*d* formed to slant for moving the operating unit 60 in an opposite direction along an axial direction of the camshaft 10. In addition, the one guide rail 68*c* and the other guide rail 68*d* are formed to cross to each other to form an X-shape. Further, the crossing point of the X-shape may be a center of the one guide rail 68*c* and the other guide rail 68*d*, and the one guide rail 68*c* and the other guide rail 68*d* may be formed with the same length along a circumferential direction of the operating unit 60. Herein, the length of the one guide rail 68*c* and the other guide rail 68*d* may be longer than half a length of the circumference of the operating unit 60.

A protrusion portion 69*b* is formed on a part of an exterior circumference of the operating unit 60 where the two guide rails 68*c* and 68*d* are not formed. Herein, the protrusion portion 69*b* is a portion which is relatively protruded compared with the groove shape guide rails 68*a* and 68*b*, and is a part of an exterior circumference of the operating unit 60 which is not recessed.

The one guide rail 68*c* includes a starting point P1 in one end thereof and an ending point P2 in the other end thereof, and the other guide rail 68*d* includes a starting point P3 in one end thereof and an ending point P4 in the other end thereof. In addition, the one starting point P1 and the other starting point P3 are upper portions of the X-shape and are disposed to be parallel with each other, and the one ending point P2 and the other point P4 are lower portions of the X-shape and are disposed to be parallel with each other. That is, the protrusion portion 69*b* is formed between the starting points P1 and P3 and the ending points P2 and P4 on a surface opposite to the surface having the X-shape.

The operating portion 47 of the solenoid 40 contacts the starting point P1, and the operating portion 47 is slid to the ending point P2 along the one guide rail 68*c* by rotation of the operating unit 60. Thus, the operating unit 60 is moved in the one direction.

The operating portion 47 that has slid to the ending point P2 begins to escape from the one guide rail 68*c* at the same time that the operating portion 47 contacts the protrusion portion 69*b*. In addition, the operating portion 47 passes through the protrusion portion 69*b* by rotation of the operating unit 60.

If the operating portion 47 passing through the protrusion portion 69*b* between the ending point P2 and the starting point P3 contacts the starting point P3, the operating portion 47 is slid to the ending point P4 along the other guide rail 68*d* by rotation of the operating unit 60. Thus, the operating unit 60 is moved in the opposite direction.

The operating portion 47 that has slid to the ending point P4 begins to escape from the other guide rail 68*d* at the same time that the operating portion 47 contacts the protrusion portion 69*b*. In addition, the operating portion 47 passes through the protrusion portion 69*b* by rotation of the operating unit 60. Further, the operating portion 47 passing through the protrusion portion 69*b* between the ending point P4 and the starting point P1 may contact the starting point P1.

As the two guide rails 68*c* and 68*d* having the groove shape are formed to cross each other by the X-shape, the operating unit 60 performs one reciprocal rectilinear motion per two rotations of the operating unit 60. That is, the high-low-high lift or the low-high-low lift of the valve 80 can be sequentially performed per two rotations of the operating unit 60. This means that changing from the high lift to the low lift or from the low lift to the high lift can be performed per rotation of the camshaft 10, and the changing time of the lift may be predetermined by a person of ordinary skill in the art.

Meanwhile, a slanted surface S, having a shape such that the guide rails 68*c* and 68*d* are gradually recessed from an exterior circumference of the operating unit 60, is formed at portions of the starting points P1 and P3 and the ending points P2 and P4. Therefore, the operating portion 47 of the solenoid 40 can be smoothly seated on the guide rails 68*c* and 68*d* without impact, and can smoothly escape from the guide rails 68*c* and 68*d* without impact.

Various embodiments in which the guide rails 68*e* and 68*f* having a protrusion shape are formed at the operating unit 60 will now be described with reference to FIG. 11 and FIG. 12.

The guide rails 68*e* and 68*f* may be formed in a protrusion shape protruded from an exterior circumference of the operating unit 60. In addition, the protrusion shape guide rails 68*e* and 68*f* are elongated extending along a circumferential direction of the operating unit 60, and are slanted by a set slope with reference to an axial direction.

The operating portion 47 of the solenoid 40 includes a coupling portion 48 and a coupling groove 49 so as to contact the protrusion shape guide rails 68*e* and 68*f*.

The coupling groove 49 is a groove which is formed in a shape corresponding with the guide rails 68*e* and 68*f* at the coupling portion 48 such that the protrusion shape guide rails 68*e* and 68*f* are inserted into the coupling groove 49, and the coupling portion 48 is formed at one end of the operating portion 47 so as to ensure an extent of forming the coupling groove 49. In addition, the coupling portion 48 functions to escape the coupling groove 49 from the guide rails 68*e* and 68*f*.

If the coupling groove 49 of the solenoid 40 contacts the guide rails 68*e* and 68*f*, the operating portion 47 is slid along a length direction of the guide rails 68*e* and 68*f* by rotation of the camshaft 10 and the operating unit 60. Herein, the solenoid 40 is fixed to a vehicle body, and thus the operating portion 47 is fixed, and the operating unit 60 is moved along an axial direction of the camshaft 10 according to the shape of the slanted guide rails 68*e* and 68*f* by the fixed operating portion 47. Meanwhile, the camshaft 10 and the operating unit 60 are concentrically rotated about a same rotating center point C.

The protrusion shape guide rails 68*e* and 68*f* may be a pair of guide rails 68*e* and 68*f*, and the two guide rails 68*e* and 68*f* are disposed so as to face each other along a diameter direction of the operating unit 60. In addition, a protrusion portion 69*c* is formed between the two guide rails 68*e* and 68*f*. Herein, the protrusion portion 69*c* is a portion which is protruded from an exterior circumference of the operating unit 60, and is formed on a part of an exterior circumference of the operating unit 60 where the protrusion shape guide rails 68*e* and 68*f* are not formed.

One guide rail 68*e* of the two guide rails 68*e* and 68*f* is formed to slant so as to move the operating unit 60 in one direction along an axial direction of the camshaft 10, and the other guide rail 68*f* of the two guide rails 68*e* and 68*f* is formed to slant so as to move the operating unit 60 in an opposite direction along an axial direction of the camshaft 10. In addition, the one guide rail 68*e* includes a starting point P1 in one end thereof and an ending point P2 in the other end thereof, and the other guide rail 68*f* includes a starting point P3 in one end and an ending point P4 in the other end. That is, the protrusion portions 69*c* are respectively formed between the ending point P2 and the starting point P3, and between the ending point P4 and the starting point P1.

If the coupling groove 49 of the solenoid 40 contacts the starting point P1, the operating portion 47 is slid to the ending point P2 along the one guide rail 68*e* by rotation of the operating unit 60. Thus, the operating unit 60 is moved in the one direction.

The operating portion 47 that has slid to the ending point P2 begins to escape from the one guide rail 68*e* at the same time that the operating portion 47 contacts the protrusion portion 69*c*. At this time, the coupling portion 48 of the operating portion 47 is pushed by the protrusion portion 69*c* and is returned to the original position. In addition, the coupling portion 48 of the operating portion 47 passes through the protrusion portion 69*c* by rotation of the operating unit 60.

If the coupling groove 49 passing through the protrusion portion 69*c* between the ending point P2 and the starting point P3 contacts the starting point P3, the operating portion 47 is slid to the ending point P4 along the other guide rail 68*f* by rotation of the operating unit 60. Thus, the operating unit 60 is moved in the opposite direction.

The operating portion 47 that has slid to the ending point P4 begins to escape from the other guide rail 68*f* at the same time that the operating portion 47 contacts the protrusion portion 69*c*. At this time, the coupling portion 48 of the operating portion 47 is pushed by the protrusion portion 69*c* and is returned to the original position. In addition, the coupling portion 48 of the operating portion 47 passes through the protrusion portion 69*c* by rotation of the operating unit 60. Further, the coupling portion 48 passing through the protrusion portion 69 between the ending point P4 and the starting point P1 may contact the starting point P1.

As there are two protrusion shape guide rails 68*e* and 68*f* disposed so as to face each other along a diameter direction of the operating unit 60, the operating unit 60 performs one reciprocal rectilinear motion per rotation of the operating unit 60. That is, the high-low-high lift of the valve 80 can be sequentially performed per rotation of the operating unit 60, or the low-high-low lift of the valve 80 can be sequentially performed per rotation of the operating unit 60. This means that changing from the high lift to the low lift or from the low lift to the high lift can be performed every half rotation of the camshaft 10, and the changing time of the lift may be predetermined by a person of ordinary skill in the art.

Meanwhile, a slanted surface S, having a shape such that the guide rails 68*e* and 68*f* are gradually protruded from an exterior circumference of the operating unit 60, is formed at portions of the starting points P1 and P3 and the ending points P2 and P4. Therefore, the guide rails 68*e* and 68*f* can be smoothly seated on the coupling groove 49 of the operating portion 47 without impact. In addition, a slanted surface S, having a shape such that the protrusion portion 69*c* is gradually protruded from an exterior circumference of the operating unit 60, is formed at one end and the other end of the protrusion portion 69*c* in a length direction thereof. Therefore, the coupling portion 48 of the operating portion 47 can be smoothly returned to the original position without impact.

Various embodiments in which other guide rails 68*g* and 68*h* having a protrusion shape is formed at the operating unit 60 will now be described with reference to FIG. 13.

The guide rails 68*g* and 68*h* may be formed in a protrusion shape protruded from an exterior circumference of the operating unit 60. In addition, the protrusion shape guide rails 68*c* and 68*d* are elongated extending along a circumferential direction of the operating unit 60, and are slanted by a set slope with reference to an axial direction.

The operating portion 47 of the solenoid 40 includes a coupling portion 48 and a coupling groove 49 for contacting the protrusion shape guide rails 68*g* and 68*h*. A repeated description regarding the coupling portion 48 and coupling groove 49 will be omitted.

If the coupling groove 49 of the solenoid 40 contacts the guide rails 68*g* and 68*h*, the operating portion 47 is slid along a length direction of the guide rail 68*g* and 68*h* by rotation of the camshaft 10 and the operating unit 60. Herein, the solenoid 40 is fixed to a vehicle body, and thus the operating portion 47 is fixed, and the operating unit 60 is moved along an axial direction of the camshaft 10 according to the shape of the slanted guide rails 68*g* and 68*h* by the fixed operating portion 47. Meanwhile, the camshaft 10 and the operating unit 60 are concentrically rotated about a same rotating center point C.

The protrusion shape guide rails 68*g* and 68*h* includes one guide rail 68*g* formed to slant for moving the operating unit 60 in one direction along an axial direction of the camshaft 10, and the other guide rail 68*h* formed to slant for moving the operating unit 60 in an opposite direction along an axial direction of the camshaft 10. In addition, the one guide rail 68*g* and the other guide rail 68*h* are formed to cross to each other to form an X-shape. Further, the crossing point of the X-shape may be a center of the one guide rail 68*g* and the other guide rail 68*h*, and the one guide rail 68*g* and the other guide rail 68*h* may be formed with the same length along a circumferential direction of the operating unit 60. Herein, the length of the one guide rail 68*g* and the other guide rail 68*h* may be longer than half of the circumference of the operating unit 60.

A protrusion portion 69*d* is formed on a part of an exterior circumference of the operating unit 60 where the two guide rails 68*g* and 68*h* are not formed. Herein, the protrusion portion 69*d* is a portion which is protruded from an exterior circumference of the operating unit 60, and is formed on a part of an exterior circumference of the operating unit 60 where the protrusion shape guide rails 68*g* and 68*h* are not formed.

The one guide rail 68*g* includes a starting point P1 in one end thereof and an ending point P2 in the other end thereof, and the other guide rail 68*h* includes a starting point P3 in one end thereof and an ending point P4 in the other end thereof. In addition, the one starting point P1 and the other starting point P3 are upper portions of the X-shape and are disposed to be parallel with each other, and the one ending point P2 and the other point P4 are lower portions of the X-shape and are disposed to be parallel with each other. That is, the protrusion portion 69*b* is formed between the starting points P1 and P3 and the ending points P2 and P4 on an opposite surface of the surface having the X-shape.

The one guide rail 68*g* and the other guide rail 68*h* crossing with the X-shape are together include a crossed rail 70 and a crossed groove 72.

The crossed rail 70 is formed in a rhomboid shape at the crossing point of the X such that it is possible for the coupling groove 49 of the solenoid 40 to be slid, and the crossed groove 72 is formed around the crossed rail 70 having the rhomboid shape so as to guide the coupling portion 48 neighboring the coupling groove 49. Herein, the crossed rail 70 is protruded from an exterior circumference of the operating unit 60 like the guide rails 68*g* and 68*h*. That is, the guide rails 68*g* and 68*h* are cut at a set distance in a circumference of the crossed rail 70, and the crossed groove 72 is an exterior circumference of the operating unit 60 which is exposed at the portion where the guide rails 68*g* and 68*h* are cut.

The crossed rail 70 is formed in the rhomboid shape, and the crossed groove 72 is formed along a circumference of the rhomboid shape crossed rail 70 such that at least one part of the coupling groove 49 always contacts at least one part of the guide rails 68*g* and 68*h*. That is, the at least one part of the coupling groove 49 is always guided by the at least one part of the guide rails 68*g* and 68*h*.

If the coupling groove 49 of the solenoid 40 contacts the starting point P1, the operating portion 47 is slid to the ending point P2 along the one guide rail 68*g* by rotation of the operating unit 60. Thus, the operating unit 60 is moved in the one direction.

The operating portion 47 that has slid to the ending point P2 begins to escape from the one guide rail 68*g* at the same time that the operating portion 47 is contacts the protrusion portion 69*d*. At this time, the coupling portion 48 of the operating portion 47 is returned to the original position by pushing of the protrusion portion 69*d*. In addition, the coupling portion 48 of the operating portion 47 passes through the protrusion portion 69*d* by rotation of the operating unit 60.

If the coupling groove 49 passing through the protrusion portion 69*d* between the ending point P2 and the starting point P3 contacts the starting point P3, the operating portion 47 is slid to the ending point P4 along the other guide rail 68*h* by rotation of the operating unit 60. Thus, the operating unit 60 is moved in the opposite direction.

The operating portion 47 that has slid to the ending point P4 begins to escape from the other guide rail 68*h* at the same time that the operating portion 47 contacts the protrusion portion 69*d*. At this time, the coupling portion 48 of the operating portion 47 is returned to the original position by pushing of the protrusion portion 69*d*. In addition, the coupling portion 48 of the operating portion 47 passes through the protrusion portion 69*d* by rotation the operating unit 60. Further, the coupling groove 49 passing through the protrusion portion 69*d* between the ending point P4 and the starting point P1 may contact the starting point P1.

As the two guide rails 68*g* and 68*h* having the protrusion shape are formed to cross each other with the X-shape, the operating unit 60 performs one reciprocal rectilinear motion per two rotations of the operating unit 60. That is, the high-low-high lift or the low-high-low lift of the valve 80 can be sequentially performed per two rotations of the operating unit 60. This means that changing from the high lift to the low lift or from the low lift to the high lift can be performed per rotation of the camshaft 10, and the changing time of the lift may be predetermined by a person of ordinary skill in the art.

Meanwhile, a slanted surface S, having a shape such that the guide rail 68*g* and 68*h* is gradually protruded from an exterior circumference of the operating unit 60, is formed at portions of the starting points P1 and P3 and the ending points P2 and P4. Therefore, the guide rails 68*g* and 68*h* can be smoothly seated on the coupling groove 49 of the operating portion 47 without impact. In addition, a slanted surface S, having a shape such that the protrusion portion 69*d* is gradually protruded from an exterior circumference of the operating unit 60, is formed at one end and the other end of the protrusion portion 69*d* in a length direction thereof. Therefore, the coupling portion 48 of the operating portion 47 can be smoothly returned to the original position without impact.

According to various embodiments of the present invention, the constitution may be simplified by the hollow camshaft 10 and the control shaft 20 inserted into the hollow of the camshaft 10, and simultaneously, efficient operation can be possible. In addition, interference between constituent elements may be prevented, and spatial utility can be improved.

For convenience in explanation and accurate definition in the appended claims, the terms upper or lower, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A multiple variable valve lift apparatus, comprising:

an engine-driven camshaft having a hollow cylinder shape;

control shafts disposed in a hollow of the camshaft;

a cam disposed on an exterior circumference of the camshaft to rotate together with the camshaft;

a cam rod connecting the control shaft with the cam such that the control shaft and the cam move together;

an operating unit disposed on the exterior circumference of the camshaft to rotate together with the camshaft;

an operating unit rod connecting the control shaft with the operating unit such that the control shaft and the operating unit move together;

a solenoid selectively connected with the operating unit, and moving the operating unit along an axial direction of the camshaft; and a tappet contacting the cam to transform rotational motion of the cam to rectilinear motion of a valve;

wherein the cam includes at least two cams in which shapes of cam lobes are different from each other and move together with the operating unit along the axial direction of the camshaft such that a cam contacting to a tappet of one of the at least two cams is selected, wherein the control shafts are separately provided such that the number of the control shafts corresponds to the number of cylinders formed in an engine, and the control shafts are respectively connected to at least one cam of the at least two cams to independently control valve lift in each cylinder of the engine.

2. The apparatus of claim 1, wherein the at least two cams include a cylinder shape having a hollow such that the camshaft is inserted therein.

3. The apparatus of claim 2, wherein a cam guide hole is formed in the camshaft by penetrating the camshaft along a diameter direction, and the cam rod penetrates the camshaft along a diameter direction through the cam guide hole to connect the cam with the control shaft.

4. The apparatus of claim 3, wherein the cam guide hole is formed with a set length along the axial direction of the camshaft, and the cam rod is guided by the cam guide hole to move together with the at least two cams and the control shaft along the axial direction of the camshaft.

5. The apparatus of claim 1, wherein the operating unit is formed in a cylinder shape having a hollow such that the camshaft is inserted therein.

6. The apparatus of claim 5, wherein an operating unit guide hole is formed at the camshaft by penetrating the camshaft along a diameter direction, and the operating unit rod penetrates the camshaft along the diameter direction through the operating unit guide hole to connect the operating unit with the control shaft.

7. The apparatus of claim 6, wherein the operating unit guide hole is formed with a set length along the axial direction of the camshaft, and the operating unit rod is guided by the operating unit guide hole to move together with the operating unit and the control shaft along the axial direction of the camshaft.

8. The apparatus of claim 1, wherein the control shafts are connected with the at least two cams to concurrently control valve lifts by applying the control shafts to at least two cylinders formed at the engine.

9. The apparatus of claim 1, wherein the tappet comprises:

a lower portion formed in a cylinder shape; and an upper portion protruded from an upper surface of the lower portion and receiving rotational motion of the at least two cams.

10. The apparatus of claim 9, wherein the upper portion is formed in a hexahedral shape having a lower surface meeting the upper surface of the lower portion, an upper surface contacting the at least two cams, and four side surfaces, and the upper surface of the upper portion is elongated extending along one direction for extending the time that the tappet is operated by the cam lobe of the at least two cams.

11. The apparatus of claim 10, wherein the upper surface of the upper portion is convexly formed with a fluent curved surface along a length direction.

12. The apparatus of claim 9, wherein the tappet further comprises a locking pin preventing a relative rotation of the tappet with respect to a cylinder head, the locking pin is formed in a bent shape to be mounted on the lower portion from a side surface to the upper surface of the lower portion, and a thickness of one direction of the upper portion is smaller than a diameter of the lower portion for mounting the bent locking pin on the lower portion.

13. The apparatus of claim 1, wherein an operating portion selectively contacting the operating unit is provided to the solenoid, a guide rail is formed on an exterior circumference of the operating unit and is slanted with reference to an axial direction to guide the contacted operating portion, and the operating portion is slid along the guide rail by rotation of the operating unit such that the operating unit moves along the axial direction of the camshaft.

14. The apparatus of claim 13, wherein there is at least two guide rails formed for moving the operating unit in one direction or an opposite direction along the axial direction.

15. The apparatus of claim 14, wherein each guide rail is formed with a groove shape recessed from an exterior circumference of the operating unit, and the operating portion is adapted to be inserted into the guide rail formed with the groove shape.

16. The apparatus of claim 15, wherein two guide rails formed with the groove shape are disposed to face each other along a diameter direction of the operating unit, a protrusion portion relatively protruded compared with the guide rail is formed between the two guide rails on an exterior circumference of the operating unit, and the operating portion escapes from the guide rail when the operating portion passing the guide rail contacts the protrusion portion by rotation of the operating unit.

17. The apparatus of claim 15, wherein two guide rails formed with the groove shape are disposed to cross with an X-shape, a protrusion portion relatively protruded compared with the guide rail is formed on a part of an exterior circumference of the operating unit where the two guide rails are not formed, and the operating portion escapes from the guide rail when the operating portion passing the guide rail contacts the protrusion portion by rotation of the operating unit.

18. The apparatus of claim 14, wherein the guide rail is formed with a protrusion shape protruded from an exterior circumference of the operating unit, and a groove is formed at the operating portion such that the guide rail formed in the protrusion shape is adapted to be inserted into the groove.

19. The apparatus of claim 18, wherein two guide rails formed with the groove shape are disposed to face each other along a diameter direction of the operating unit, a protrusion portion protruded from an exterior circumference of the operating unit is formed between the two guide rails on an exterior circumference of the operating unit, and the operating portion is moved back to its original position when the operating portion passing the guide rail contacts the protrusion portion by rotation of the operating unit.

20. The apparatus of claim 18, wherein two guide rails formed with the groove shape are disposed to cross with a X-shape, a protrusion portion protruded from an exterior circumference of the operating unit is formed on a part of an exterior circumference of the operating unit where the two guide rails are not formed, and the operating portion is moved back to its original position when the operating portion passing the guide rail contacts the protrusion portion by rotation of the operating unit.

21. The apparatus of claim 20, wherein the two guide rails comprise:

a crossed rail formed with a rhomboid shape at the crossing point of the X-shape for sliding the groove of the operating portion; and a crossed groove formed such that the two guide rails are cut at a set distance around the crossed rail.

22. The apparatus of claim 14, wherein in a case that there are two guide rails formed, the two guide rails are disposed such that the operating portion sequentially passes one end and the other end of either of the two guide rails and one end and the other end of the other of the two guide rails according to rotation of the operating unit in a state that the operating portion contacts the operating unit.

* * * * *